US005884814A

United States Patent [19]

Nelson

[11] Patent Number: 5,884,814

[45] Date of Patent: Mar. 23, 1999

[54] METHOD AND APPARATUS FOR ENSURING THE PUMPABILITY OF FLUIDS EXPOSED TO TEMPERATURES COLDER THAN THE POUR POINT OF SUCH FLUIDS

[76] Inventor: Charles M. Nelson, 2000 Bay Area Blvd. #603, Houston, Tex. 77058

[21] Appl. No.: 883,200

[22] Filed: Jun. 26, 1997

[51] Int. Cl.[6] ..... B67D 5/63

[52] U.S. Cl. ..... 222/146.2; 222/105; 222/146.4

[58] Field of Search ..... 222/105, 146.5, 222/146.4, 146.2; 165/46, 169

[56] References Cited

U.S. PATENT DOCUMENTS

| | | | |
|---|---|---|---|
| 302,017 | 7/1884 | Orcutt . | |
| 1,562,991 | 11/1925 | Rudigier . | |
| 3,233,662 | 2/1966 | Yuen | 165/46 |
| 3,583,415 | 6/1971 | Smith . | |
| 3,945,534 | 3/1976 | Ady . | |
| 4,212,498 | 7/1980 | Vandenbossche | 165/136 |
| 4,454,945 | 6/1984 | Jabarin et al. . | |
| 4,817,707 | 4/1989 | Aoyama et al. | 165/46 |
| 5,468,117 | 11/1995 | Lobko et al. | 414/786 |

*Primary Examiner*—Andres Kashnikow
*Assistant Examiner*—David Deal
*Attorney, Agent, or Firm*—Browning Bushman

[57] ABSTRACT

A steel-bodied shipping container having two lockable doors, and at one of its ends has an insulation pad positioned on its floor. A heat exchanger pad having a hot water/steam hose embodied therein is positioned on top of the insulation pad, with the inlet/outlet ends of the hose positioned near a first of the ends doors. A flexible bladder positioned on top of the heat exchanger pad, is pumped full of a material. The first door is locked and the shipping container shipped. At destination, hot water or steam is pumped through the heat exchanger pad to raise the temperature of the material within the flexible bladder, after which the material is pumped out of the flexible bladder.

11 Claims, 4 Drawing Sheets

METHOD AND APPARATUS FOR ENSURING THE PUMPABILITY OF FLUIDS EXPOSED TO TEMPERATURES COLDER THAN THE POUR POINT OF SUCH FLUIDS

BACKGROUND OF THE INVENTION

Many fluids are pumpable only when heated above normal ambient temperatures. Corn syrup, for example, requires a temperature of approximately 125° F. to be easily pumpable. Also, fluids frequently are shipped to, or through frigid areas which cause the fluids to become solid, or semi-solid, and which as a result of such frigid temperatures cannot be easily pumped out of their containers. The present invention provides a method and apparatus which enables the fluids to be easily pumped out of flexible containers despite having been exposed to reduced temperatures.

PRIOR ART

The prior art has long recognized the problem of shipping fluids through reduced temperature regions of the earth. For example, when shipping corn syrup, the syrup usually must be heated before the syrup can be pumped out of the container. In U.S. Pat. No. 302,017 to E. L. Orcutt, especially in FIG. 4, a steam jacket is placed around the bottom of a kettle A to cause the sugar syrup to flow easily.

In U.S. Pat. No. 1,562,991 to E. A. Rudigier, a railway tank car is equipped with tubes running through the interior of the tank through which steam or other heating fluid can be supplied to heat the transported material and facilitate the unloading of the transported material.

In U.S. Pat. No. 3,945,534 to E. W. Ady, there is a disclosure of a flexible bag containing an unidentified food, and having a bag containing a processing fluid 24 for heating the food within the container.

U.S. Pat. No. 3,583,415 to V. D. Smith shows a plurality of corn syrup tanks equipped with a heat exchanger and hot water tubes both within and around tube 88 carrying the corn syrup, to heat the syrup and thus allow the continuous flow of the liquid syrup.

U.S. Pat. No. 4,454,945 to S. A. Jabarin et al. Shows a flexible bag 21 transported within a crate or box, but containing no method or apparatus for heating the contents within the flexible bag.

The prior art also includes stainless steel or carbon steel tanks, transportable by tractor-trailer trucks or the like, having steam channels on the lower half of the tanks, and on some designs, around the tank circumference. Such tanks, sometimes known as "ISOTANKS", are widely available for example, from Twinstar Leasing, Ltd., located at 1700 One Riverway, Houston, Tex., 77056.

The prior art has failed, however, to address the need for being able to ship a flexible container, such as the fluid-containing container shown in U.S. Pat. No. 4,454,945, through or to reduced temperature areas, and the need to easily pump the contents of the flexible container without modifying the container itself

SUMMARY OF THE INVENTION

In its most general sense, a pad containing a heat exchanger is placed in the bottom and/or around the sides of the shipping container. The flexible container, which either contains the liquid to be shipped, or which will contain such liquid, is placed on the pad and the shipping container is closed, if desired, and shipped. Upon arriving at the shipping destination, the heat exchanger is activated, causing the temperature of the shipped material to become liquid and easily pumped out of the flexible bag.

In a more specific sense, the pad contains one or more hoses through which steam or hot water can be pumped to raise the temperature of the shipped material.

As one feature of the invention, the hose within the pad is patterned such that the inlet and outlet ends of the hose are positioned in near proximity to each other and to the access door of the shipping container.

As another feature of the invention, insulation is provided beneath the heat exchanger pad to alleviate the problem of heat loss from the heat exchanger down through the steel bottom of the shipping container, since excessive heat loss would extend the period for heating up the shipped materials.

These and other objects, features and advantages of the present invention will become apparent from a reading of the following detailed description of the invention, taken in conjunction with the accompanying drawings.

DESCRIPTION OF THE PREFERRED EMBODIMENT

Figure 1:
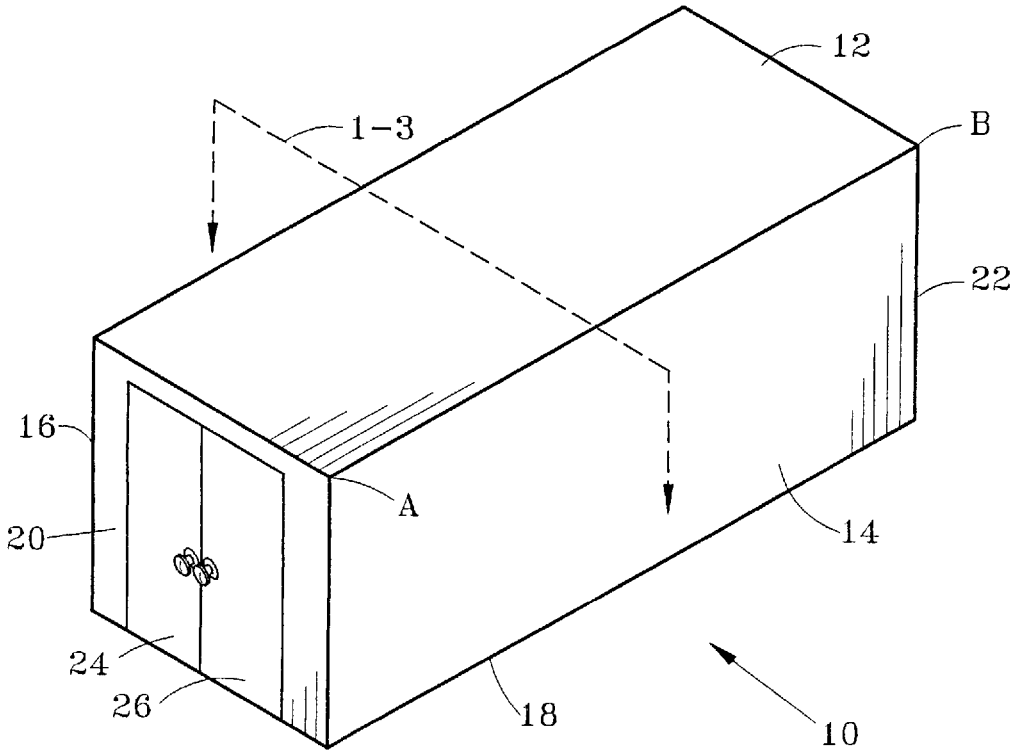
FIG. 1 is a pictorial, isometric view of a steel-bodied shipping container used with the system according to the present invention.

FIG. 1 is a pictorial, isometric view of a steel bodied shipping container 10 having nominal dimensions of 20 feet long (between points A and B), 8 feet wide and 8 feet high. Such shipping containers, having the shape of a parallelepiped box, are conventional and are available also in 40 foot length sizes. The top plate 12, the side plates 14 and 16, the end plates 20 and 22, and the bottom plate 18 are all welded together, with the only access to the interior of the shipping container 10 being through a pair of lockable steel doors 24 and 26. The left door 24 in the shipping container 10 is usually left locked closed during the shipping of the container 10 to provide mechanical strength. As will be explained hereinafter, the right hand door 26 provides access for the pumping operations, both loading and unloading.

Figure 2:
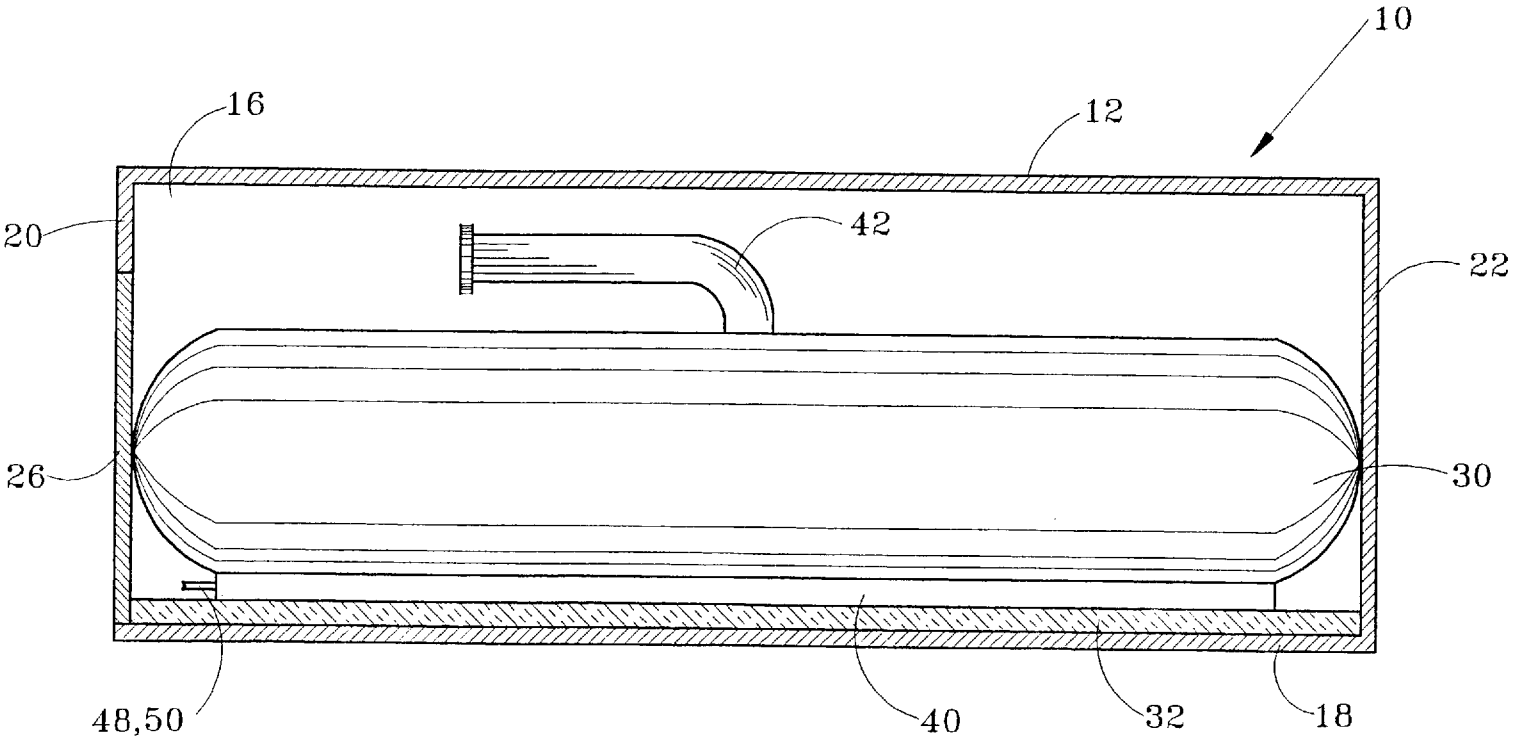
FIG. 2 is an elevated side view, partly in cross-section, of a flexible container in its full mode within the shipping container of FIG. 1 according to the present invention.
Figure 3:
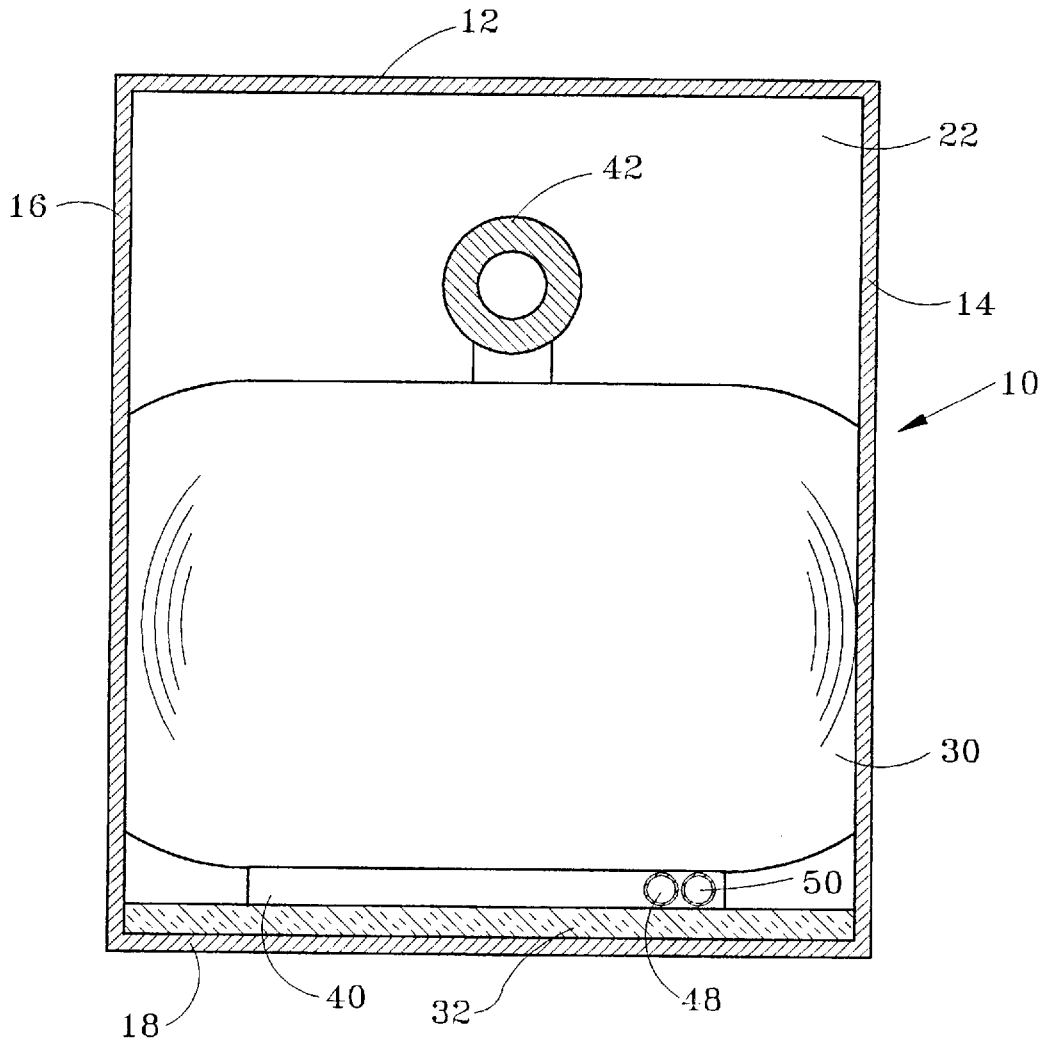
FIG. 3 is an elevated end view, partly in cross-section, taken along the sectional lines 1–3 of FIG. 1 according to the present invention.
Figure 4:
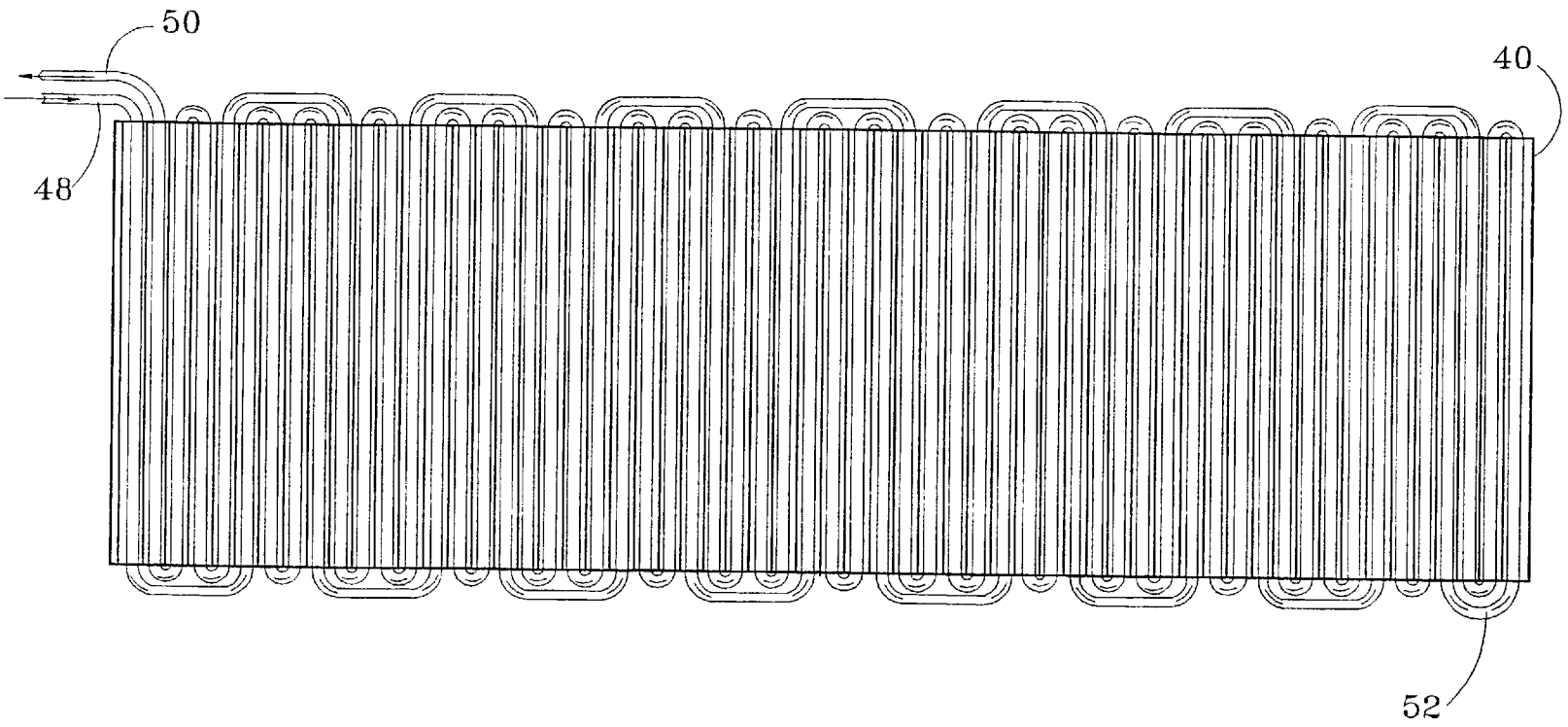
FIG. 4 is a bottom plan view of the heat exchanger pad used with the present invention.

FIG. 2 illustrates a flexible bladder 30 which is illustrated in its full mode, being full of corn syrup, for example. The flexible tank 30 is positioned immediately on top of the heat exchanger pad 40. The heat exchanger pad 40, described in more detail with respect to FIGS. 3 and 4, is resting upon an insulation pad 32, which in the preferred embodiment is two-inch thick isocynurate foam. The insulating pad 32 can be made in a rectangular pattern 20 feet by 8 feet, or slightly less to coincide with the interior dimension of the bottom plate 18 of the shipping container 10, or can be made smaller if desired to match the dimensions of pad 40.

The flexible tank 30 is conventional, and contains a flexible hose connection 42 for pumping materials into and out of the flexible bladder 30 through the access door 26.

Referring now to FIG. 3, there is illustrated a view, partly in cross section, of the shipping tank 10, taken along the sectional lines 1–3 of FIG. 1, illustrating the flexible bladder 30, in its full mode, resting on the pad 40, which is positioned on insulating pad 32, which in turn is positioned on the bottom plate or floor 18 of the shipping container 10. The pad 40 is illustrated as having a plurality of parallel sections, coupled with loops, terminating in an inlet connection 48 and an outlet 50, together forming a hose 46 described with respect to FIG. 4

FIG. 4 illustrates in a bottom plan view the pad 40 containing a hose 46 sewn into the pad in a pattern particularly useful for the present invention, in that the inlet 48 and the outlet 50 for the hose 46 are in near proximity. This is especially advantageous in that access to the hose 46 is severely limited, accessible only through the right hand door 26 of the shipping container 10, in a very limited space. In the preferred embodiment, for use with a 20 foot shipping container 10, the pad 40 is 225 inches long, approximately 18½ feet, and 6 feet wide. Being only 6 feet wide allows room for the loops 52 within the internal dimension of the container 10 which is slightly less than 8 feet wide.

The pad 40, analogous to an envelope, is constructed of two sheets of weatherproof material, for example, tarpaulin. The hose 46 is laid out in the pattern illustrated on the bottom sheet of the pad 40. The top and bottom sheets are sewn together in 3¾ inch parallel seams to hold the hose pattern in place, there being 60 parallel pockets holding the hose 46 in its desired pattern. The hose 46 is 550 feet long. The preferred hose 46 is double walled, with a helical wound nylon inner support, having a ½ inch I.D. and 13/16 O.D., rated at 150 PSI @ 200° F. One of the seams is between each of the lengths of the hose 46 to prevent any rubbing or tangling of the hose.

In the initial stage of the operation of the system illustrated in FIGS. 1–4, both of the doors 24 and 26 of the shipping container 10 are opened and the insulating pad 32 positioned on the floor, being lower plate 18. The pad 40 is then placed on top of the pad 32, with the hose inlet and outlet being positioned at the entrance into the container 10 next to the right hand door 26. The flexible bladder 30, in its empty mode, is available in a plasticized fabric shipping valise. When empty, the flexible bladder is essentially flat. The bladder 30 is removed from the valise and placed on top of the pad 40, being careful to arrange the end of hose 42 close to the access door 26. The access ends 48 and 50 of hose 46 are also close to the access door 26. The hose 42 is flexible and can easily be connected to another hose (not illustrated) from which the pumped material, for example, corn syrup, can be pumped through the access door 26. The material being pumped into the flexible container is usually heated to facilitate the pumping into the flexible container, using conventional heating and pumping facilities, not illustrated. From the time the pumping of the material into the bladder 30 commences, until the material is finally pumped out of the bladder 30, the left-hand door 24 is locked shut to provide mechanical integrity for the system. Once the bladder 30 is pumped full, the hose 42 is disconnected from the source of the pumped material, at which point the right door 26 is locked shut and the container 10 can be shipped via railroad, trucks, ships, aircraft, or any other available means of shipping.

The problem associated with shipping materials in large flexible containers is immense. When loaded, such flexible containers may weigh almost 50,000 pounds and are accessible only through a single door at one end of the steel shipping container. Depending upon the specific gravity of the material, different volume sizes of the flexible bladder may be used to handle the weight restrictions imposed by the various government agencies, but the typical flexible bladders used in 20-foot shipping containers will hold between 4,000 and 6,000 gallons of material. The invention contemplates the shipping in flexible bladders of any non-hazardous bulk liquid requiring heat to facilitate pumping of the material, i.e., corn syrup, drilling fluids used for drilling oil and gas wells, etc.

At the shipping destination, either steam or hot water can be applied through the inlet hose opening 48, which will then exit through the hose outlet 50. I have found that the 550 feet of heat transfer hose, when energized with untrapped low pressure (20 lbs.) steam at 220°–230° F., will heat 4,000 gallons of water, initially at 65° F., to 125° F. in 48 hours. Because of the fairly large heat transfer area of the pad 40, approximately 6 feet by 18.5 feet, the system is not as likely to damage sensitive products as is seen with the smaller heat transfer areas used in the prior art. If slower heat-up is required, hot water can be used in place of the steam.

The insulated pad 32 is somewhat optional, and usually is not needed other than when the system is exposed to temperatures lower than 50° F. ambient. If not used, however, in such lower ambient temperatures, the heat from the pad 40 will be partially lost through the bottom plate 18, causing the heat-up period to be increased.

If desired, when using the system in very cold ambient temperatures, for example, below 35° F., an additional heat exchanger pad such as pad 40 can be placed around the sides of the bladder 30 and steam or hot water run through its hoses to speed up the heat-up period.

Once the material has been pumped out of the bladder 30 at the shipping destination, the bladder 30 is either folded up and shipped back to the shipper or disposed of, depending upon the type of bladder used. The pad 40 is folded up, placed in its shipping valise and returned to the desired location for re-use.

The following tests were conducted to determine the optimum operating conditions for the system according to the invention:

EXAMPLE 1

A standard 20 foot shipping container was fitted with two-inch isocynurate foam insulation with a stabilized K-Factor of 0.14 Btu-in/ft2 (aluminum foil both sides) on the floor, sides and ends. Insulation compressive strength of 25 psi allowed the installation and fitting crew to walk on the insulation without damage. The top of the loaded flexible tank was covered with a 2 two-inch Fiberglas blanket. Average ambient temperature was 55° F.

The heating pad was fitted over the floor insulation and a 23,000 liter R tank was fitted over the heating pad. The heating pad did not interfere with the flexible tank fitting. Insulating and fitting took two men 45 minutes.

The flexible tank was loaded with 4,000 gallons of water at 60° F. and heated to 80° F. with a standard home hot water heater. This proved ineffective and low pressure steam at 50 psi/230° F. was then used to energize the heating hose. The bottom of the flexible tank was exposed to a maximum temperature of 200° F.

A standard crows foot twist lock coupling was used to connect to the steam manifold. The steam manifold was set at 30 psi. This fluctuated as low as 20 psi in a transient state as other demands were put on the steam manifold.

The 4,000 gallons of water reached a maximum temperature of 140° F over a 24-hour period, after the change to steam, while average ambient temperatures fell from 65° F. to 50° F.

The steam was turned off and the flexible tank allowed to cool. The first 12 hours saw a drop of 10° F. to 130° F. with an average ambient temperature of 55° F. The next 12 hours the temperature dropped to 115° F. as the average ambient temperature dropped to 50° F. No further readings were taken.

The flexible tank was drained and moved for further testing. Inspection of the heating hose and the flexible tank showed little or no wear and tear.

EXAMPLE 2

The second series started with the test water at 65° F. and open steam at 25 pounds pressure. There was no insulation on the top of the flexible tank but the floor and side insulation were installed in the container as before. The average ambient temperature was 60° F. In the first 24 hours the temperature rose to 101° F. and over the next 24 hours rose to 122° F.

The flexible tank was drained. Inspection indicated little or no wear and tear.

The test flexible tank and heating pad were refitted into the container and the third test series run.

EXAMPLE 3

The third series started with the test water at 65° F. and open steam at 25 pounds pressure. There was no insulation on the top of the flexible tank but the floor and side insulation was installed in the container as before. The average ambient temperature was 65° F. In the first 24 hours the test water temperature rose to 101° F. and over the next 24 hours rose to 122° F.

EXAMPLE 4

The fourth series started with the test water at 67° F. and open steam at 25 pounds pressure. There was no insulation on the top of the flexible tank and the floor and side insulation was removed. The average ambient temperature was 60° F. In the first 24 hours the test water temperature rose to 88° F. and over the next 24 hours rose to 108° F.

The tests conducted indicate that I have provided a solution to a long felt need, a need to improve the pumpability of materials shipped in flexible bags to or through ambient temperatures lower than the temperatures required to easily pump such materials.

Modifications to the above described preferred embodiment will become obvious to those skilled in the art from a review of the drawings and specification set forth above. The heat exchanger pad could include other configurations, for example, a circular hose pattern for circulating steam or hot water. In a similar vein, the shipping container could be square, and could be sized smaller or larger than 20-foot or 40-foot parallelepipeds, and could have a single, circular side wall. The invention contemplates all such obvious modifications, and is intended to be limited only by the following claims and their equivalents.

What is claimed is:

1. Apparatus for shipping pumpable materials to or through reduced temperature regions, comprising:

a container having at least one sidewall, a top surface and a bottom surface;

a portable heat exchanger pad positioned in near proximity to said bottom surface and within the interior of said container; and a flexible bladder positioned immediately on top of said heat exchanger pad at least partially filled with said pumpable material, said heat exchanger pad having at least one hose having connections to at least one of the ends of said hose for allowing heated fluid to be pumped through said hose and thereby facilitating the pumping of said material from the interior of said flexible bladder.

2. The apparatus according to claim 1, wherein said container is a parallelepiped having two rectangular side walls, a rectangular top surface, a rectangular bottom surface, a first square end wall and a second square end wall, in which the first end wall has a pair of doors.

3. The apparatus according to claim 1, in which an insulation pad is positioned between the said heat exchanger pad and the said bottom surface.

4. The apparatus according to claim 3, in which the insulation pad is approximately two-inch thick isocynurate foam.

5. The apparatus according to claim 1, in which the said flexible bladder has an L-shaped hose integral with the upper surface of the said flexible bladder providing access to the interior of said bladder for pumping materials into or out of said bladder.

6. The apparatus according to claim 1, wherein said heated fluid is steam.

7. The apparatus according to claim 1, wherein said heated fluid is hot water.

8. A method of shipping a pumpable material to or through reduced temperature regions, comprising:

placing a heat exchanger pad containing a hose within the interior of a shipping container;

placing a flexible bladder on top of said heat exchanger pad within the interior of said shipping container, pumping the pumpable material into said flexible bladder;

shipping said shipping container to a destination;

causing a heated fluid to flow through the hose of said heat exchanger pad; and pumping the material out of said flexible bladder.

9. The method according to claim 8, including the additional step of positioning a pad of foam between the lower floor of said shipping container and the said heat exchanger pad.

10. The method according to claim 8, in which the heated fluid is steam.

11. The method according to claim 8, in which the heated fluid is hot water.

* * * * *